US006501221B1

(12) United States Patent
Kim et al.

(10) Patent No.: US 6,501,221 B1
(45) Date of Patent: Dec. 31, 2002

(54) ALTERNATING-CURRENT PLASMA DISPLAY PANEL

(75) Inventors: Noc-koo Kim, Cheonan (KR); Byeong-hwa Choi, Seoul (KR)

(73) Assignee: Samsung SDI Co., Ltd., Kyungki-do (KR)

( * ) Notice: Subject to any disclaimer, the term of this patent is extended or adjusted under 35 U.S.C. 154(b) by 227 days.

(21) Appl. No.: 09/620,136

(22) Filed: Jul. 20, 2000

(30) Foreign Application Priority Data

Jul. 20, 1999 (KR) ..... 99-29277

(51) Int. Cl.[7] ..... H01J 17/49
(52) U.S. Cl. ..... 313/583; 313/585
(58) Field of Search ..... 313/582, 584, 313/585, 587; 345/37, 55, 60, 41

(56) References Cited

U.S. PATENT DOCUMENTS 4,437,037 A * 3/1984 Harbey ..... 313/585
5,742,122 A * 4/1998 Amemiya et al. ..... 313/582
6,097,149 A * 8/2000 Miyaji et al. ..... 313/585 X

FOREIGN PATENT DOCUMENTS

GB 1433665 * 4/1976 ..... 313/585
JP 10-241577 A 9/1998

* cited by examiner

*Primary Examiner*—Ashok Patel
(74) *Attorney, Agent, or Firm*—Leydig, Voit & Mayer, Ltd.

(57) ABSTRACT

An alternating-current plasma display panel having common electrode lines, scan electrode lines, and address electrode lines arranged between first and second substrates opposite and spaced apart from each other, the common electrode lines being parallel to the scan electrode lines, the address electrode lines being orthogonal to the common electrode lines and the scan electrode lines, to define corresponding pixels at respective crossings. The input terminals to which driving signals corresponding to the common electrode lines are applied are located opposite the input terminals to which driving signals corresponding to the scan electrode lines are input. The surface areas of respective common bus electrode lines and respective scan bus electrode lines increase toward corresponding input terminals.

11 Claims, 8 Drawing Sheets

ALTERNATING-CURRENT PLASMA DISPLAY PANEL

BACKGROUND OF THE INVENTION

1. Field of the Invention

The present invention relates to an alternating-current plasma display panel (ACPDP), and more particularly, to a three-electrode surface-discharge ACPDP.

2. Description of the Related Art

FIG. 1 shows a structure of a general three-electrode surface-discharge ACPDP, FIG. 2 shows an electrode line pattern of the PDP shown in FIG. 1, and FIG. 3 shows an example of a pixel of the PDP shown in FIG. 1. Referring to the drawings, in a general three-electrode surface-discharge ACPDP 1, address electrode lines $A_1$, $A_2$, $A_m$, dielectric layers 11 and 15, scan electrode lines $Y_1$, $Y_2$, $Y_n$, common electrode lines $X_1$, $X_2$, $X_n$, phosphors 16, partition walls 17 and a MgO protective film 12 are located between front and rear glass substrates 10 and 13.

The address electrode lines $A_1$, $A_2$, $A_m$, are arranged over the front surface of the rear glass substrate 13 in a predetermined pattern. The lower dielectric layer 15 covers the entire front surface of the address electrode lines $A_1$, $A_2$, $A_m$. The partition walls 17 are located on the front surface of the lower dielectric layer 15 parallel to the address electrode lines $A_1$, $A_2$, $A_m$. The partition walls 17 partition discharge areas of the respective pixels and prevent cross talk among the respective pixels. The phosphors 16 are coated between the partition walls 17.

The common electrode lines $X_1$, $X_2$, $X_n$ and the scan electrode lines $Y_1$, $Y_2$, $Y_n$ are arranged on the rear surface of the front glass substrate 10 orthogonal to the address electrode lines $A_1$, $A_2$, $A_m$, in a predetermined pattern. The respective intersections define corresponding pixels. The common electrode lines $X_1$, $X_2$, $X_n$ and the scan electrode lines $Y_1$, $Y_2$, $Y_n$ each comprise indium tin oxide (ITO) electrode lines $X_{na}$ and $Y_{na}$, and a metal bus electrode lines $X_{nb}$ and $Y_{nb}$, as shown in FIG. 3. The upper dielectric layer 11 is entirely coats the rear surface of the common electrode lines $X_1$, $X_2$, $X_n$ and the scan electrode lines $Y_1$, $Y_2$, $Y_n$. The MgO protective film 12 for protecting the panel 1 against strong electrical fields entirely coats over the rear surface of the dielectric layer 11. A gas for forming plasma is hermetically sealed in a discharge space.

The driving method generally adopted for the PDP described above is an address/display separation driving method in which a reset step, an address step and a sustain discharge step are sequentially performed in a unit sub-field. In the reset step, wall charges remaining from the previous sub-field are erased. In the address step, the wall charges are formed in a selected pixel area. Also, in the sustain discharge step, light is produced at the pixel at which the wall charges are produced in the address step. In other words, if alternating pulses of a relatively high voltage are applied between the common electrode lines $X_1$, $X_2$, $X_n$ and the scan electrode lines $Y_1$, $Y_2$, $Y_n$, a surface discharge occurs at the pixel at which the wall charges are located. Here a plasma is formed at the gas layer of the discharge space 14 and the phosphors 16 are excited by ultraviolet light and thus emit light.

In the above-described plasma display panel 1, conventionally, the common electrode lines $X_1$, $X_2$, $X_n$ and the scan electrode lines $Y_1$, $Y_2$, $Y_n$ are all a rectangular solid.

FIG. 4 shows the common electrode lines $X_1$, $X_2$, $X_n$ and the scan electrode lines $Y_1$, $Y_2$, $Y_n$ of the conventional three-electrode surface-discharge alternating-current plasma display panel. In FIG. 4, reference numeral 10 denotes a front-surface glass substrate. Referring to FIG. 4, the respective common ITO electrode lines $X_{1a}$, $X_{2a}$, $X_{na}$ have the same cross-section area, irrespective of their lengthwise positions. Accordingly, the cross-sectional resistance values of the common ITO electrode lines $X_{1a}$, $X_{2a}$, $X_{na}$ are the same at any lengthwise position. The same structural and electrical characteristics are also applied to common bus electrode lines $X_{1b}$ and $Y_{nb}$, scan ITO electrode lines $Y_{1a}$, $Y_{2a}$, $Y_{na}$ and scan bus electrode lines $Y_{1b}$, $Y_{2b}$, $Y_{nb}$.

In to the aforementioned conventional electrode line structure, the farther from the input terminals of driving signals, the lower the driving voltages become, because of a voltage drop due to line resistance. Thus, since the amounts of discharged current flowing in the common electrode lines $X_1$, $X_2$, $X_n$ and the scan electrode lines $Y_1$, $Y_2$, $Y_n$ are different according to their lengthwise positions, the luminance of the display is not uniform. This phenomenon can be somewhat improved by constructing the electrode line structure such that the positions $C_X$ of input terminals to which driving signals corresponding to the common electrode lines $X_1$, $X_2$, $X_n$ are opposite to the positions $C_Y$ of input terminals to which driving signals corresponding to the scan electrode lines $Y_1$, $Y_2$, $Y_n$ are applied. In other words, the luminance of the display at the respective positions with respect to average time can be made uniform utilizing the characteristic of alternating-current driving.

However, the amounts of discharged current are relatively small at the central positions $C_M$ . . . , the common electrode lines $X_1$, $X_2$, $X_n$ and the scan electrode lines $Y_1$, $Y_2$, $Y_n$, thereby lowering luminance.

SUMMARY OF THE INVENTION

To solve the above problem, it is an objective of the present invention to provide an alternating-current plasma display panel (ACPDP) which can improve a picture quality by providing uniform luminance of the display throughout the screen.

Accordingly, to achieve the above objective, there is provided an alternating-current plasma display panel having common electrode lines, scan electrode lines and address electrode lines arranged between first and second substrates opposite to and spaced apart from each other, the common electrode lines being arranged parallel to the scan electrode lines, the address electrode lines being arranged orthogonally to the common electrode lines and the scan electrode lines, to define corresponding pixels at the respective intersections, wherein the positions of input terminals to which driving signals corresponding to the common electrode lines are opposite to the positions of input terminals to which driving signals corresponding to the scan electrode lines, and the top plane areas of the respective common bus electrode lines and the respective scan bus electrode lines are gradually increased toward the corresponding input terminals.

In the ACPDP according to the present invention, the cross-sectional resistance values of the respective common electrode lines and the respective scan electrode lines are decreased toward the corresponding input terminals. In other words, when a voltage is applied to the corresponding input terminals, the amount of current flowing between the input terminals and the central positions is maximized. Accordingly, the amounts of discharged current and the luminance at the central positions of the common electrode lines and the scan electrode lines can be relatively increased, thereby improving the picture quality because of the uniform luminance of the display for the overall screen.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBOIMENTS

Figure 1:
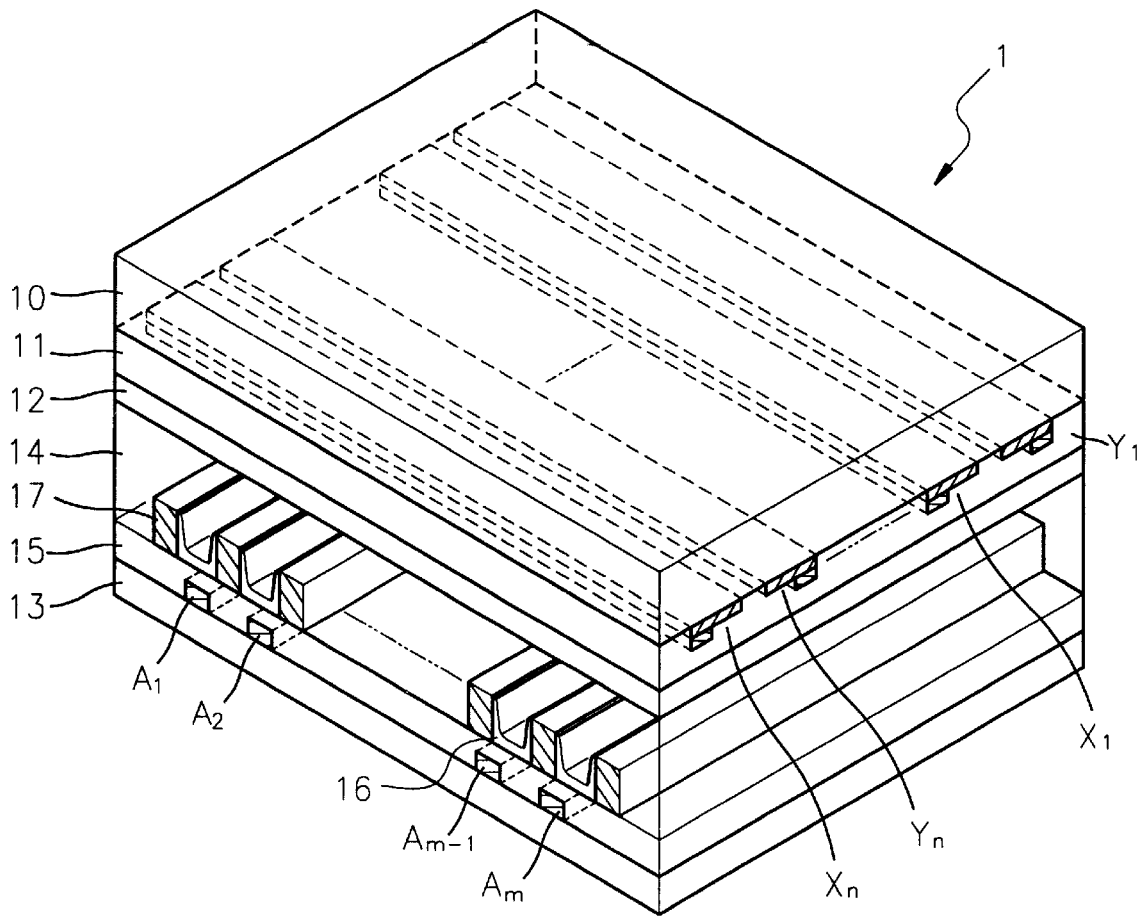
FIG. 1 shows an internal perspective view showing the structure of a general three-electrode surface-discharge ACPDP.
Figure 2:
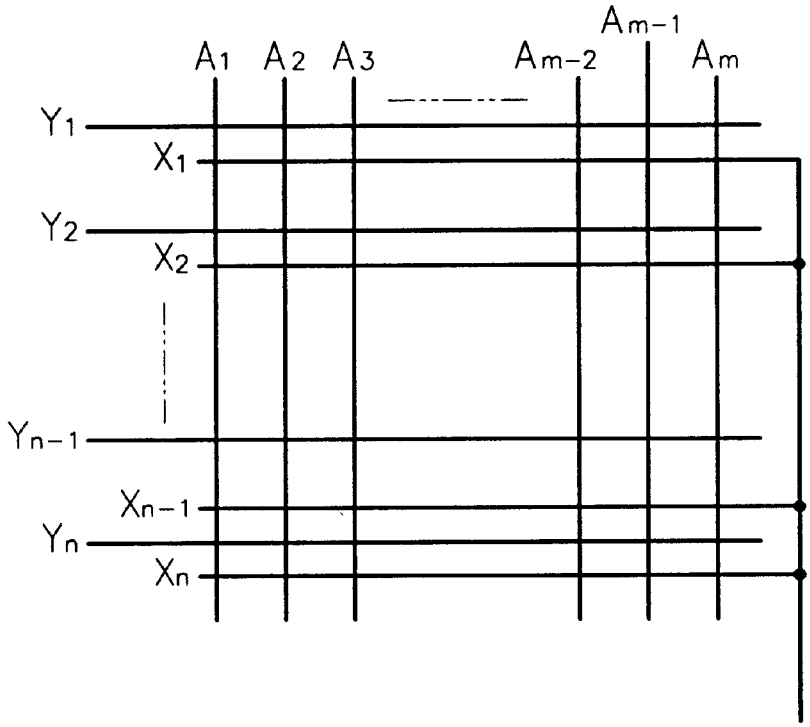
FIG. 2 is diagram showing an electrode line pattern of the PDP shown in FIG. 1.
Figure 3:
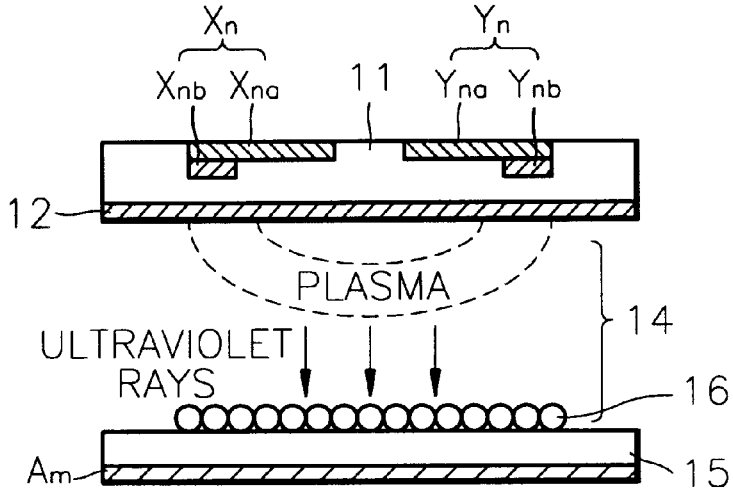
FIG. 3 is a cross section of an example of a pixel of the panel shown in FIG.
Figure 4:
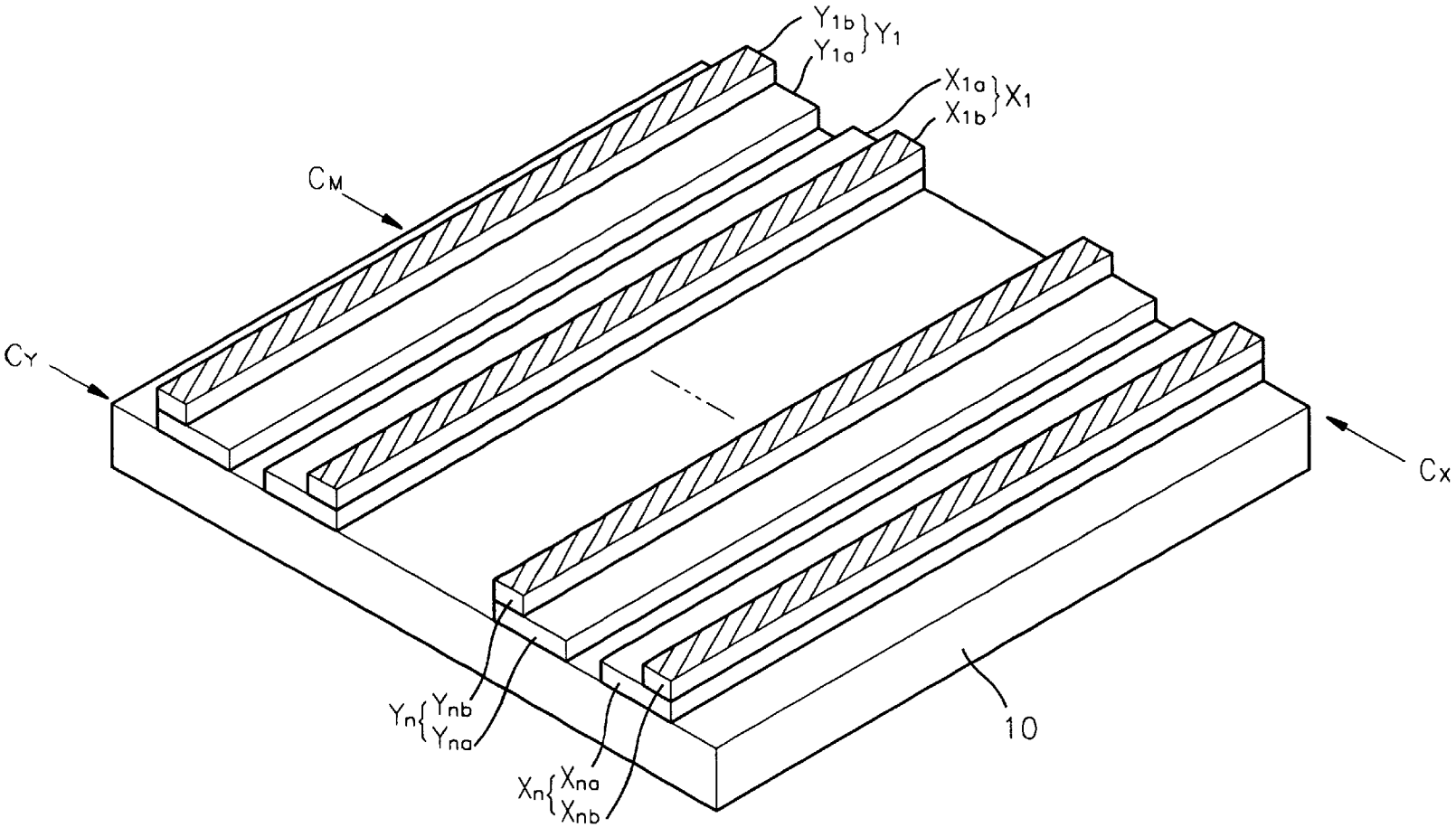
FIG. 4 (PRIOR ART)
FIG. 4 is a perspective view showing common electrode lines and scan is electrode lines of a conventional three-electrode surface-discharge ACPDP.
Figure 5:
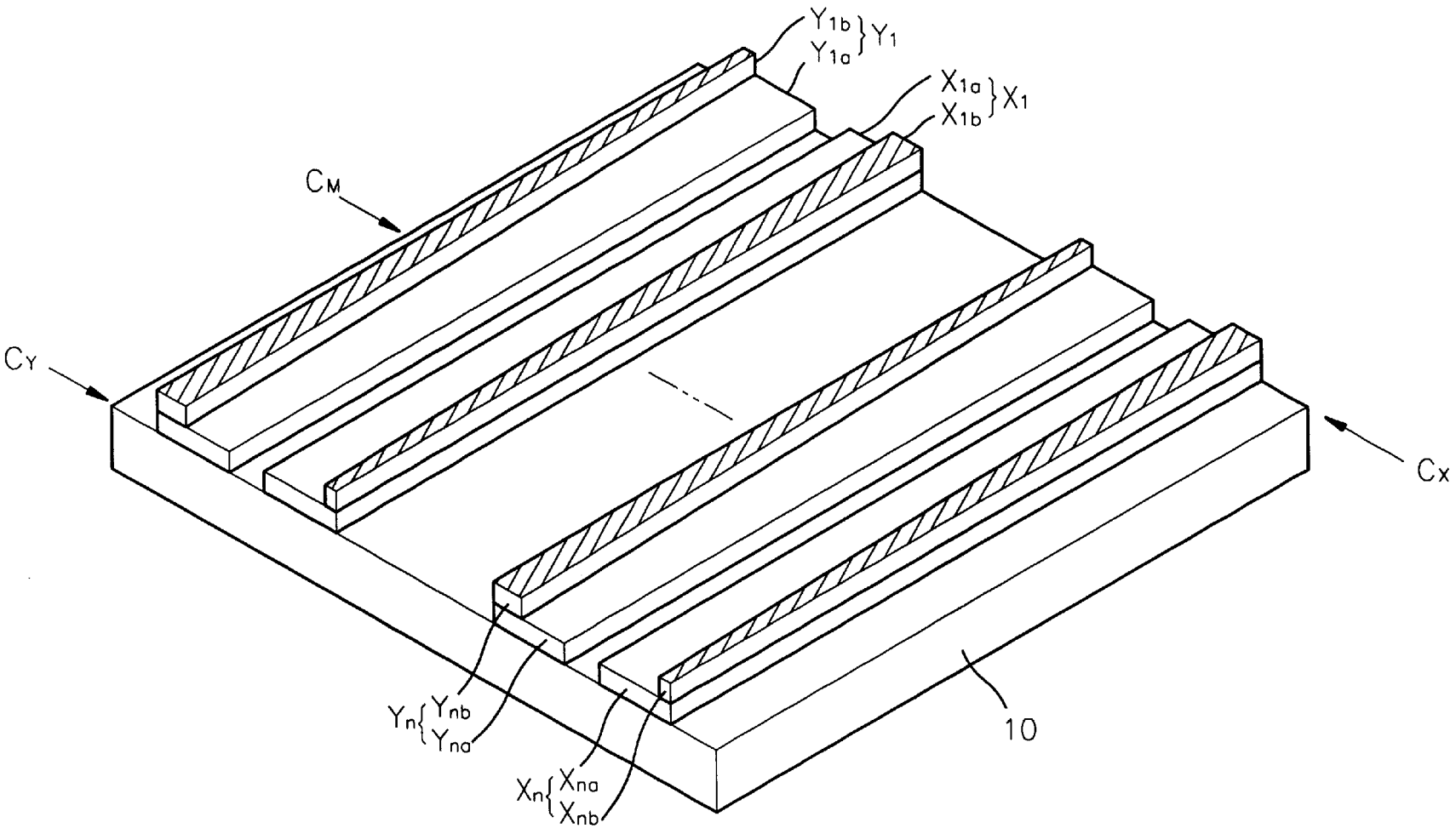
FIG. 5 is a perspective view showing common electrode lines and scan electrode lines of a three-electrode surface-discharge ACPDP according to a first embodiment of the present invention.

FIG. 5 shows common electrode lines $X_1$, $X_2$, $X_n$ and scan electrode lines $Y_1$, and $Y_n$ of a three-electrode face discharge ACPDP according to a first embodiment of the present invention. Referring to FIG. 5, the electrode line structure is configured such that the positions $C_X$ of input terminals to which driving signals corresponding to the common electrode lines $X_1$, $X_2$, are input Xare opposite to the positions $C_Y$ of input terminals to which driving signals corresponding to the scan electrode lines $Y_1$, $Y_2$, $Y_n$ are input. The respective common bus electrode lines $X_{1b}$, $X_{2b}$, $X_{nb}$ and the respective scan bus electrode lines $Y_{1b}$, $Y_{2b}$, and $Y_{nb}$ have trapezoidal top surfaces. The cross-sectional areas of the respective common bus electrode lines $X_{1b}$, $X_{2b}$, $X_{nb}$ and the respective scan bus electrode lines $Y_{1b}$, $Y_{2b}$, $Y_{nb}$ increase toward the corresponding input terminals $C_X$ and $C_Y$. Accordingly, when a voltage is applied to the corresponding input terminals, the amount of current flowing between the input terminals and the central positions can be maximized. As a result, since the amounts of discharged current and the luminance at the central positions of the common bus electrode lines $X_{1b}$, $X_{2b}$, $X_{nb}$ and the scan bus electrode lines $Y_{1b}$, $Y_{2b}$, $Y_{nb}$ relatively increase, the picture quality can be improved by the uniform luminance of the display throughout the screen. In FIG. 5, reference numeral 10 denotes a front-surface glass substrate, $X_{1a}$, $X_{2a}$, $X_{na}$ denote common ITO electrode lines, and $X_{1b}$, $X_{2b}$, $X_{nb}$ denote scan ITO electrode lines.

Figure 6:
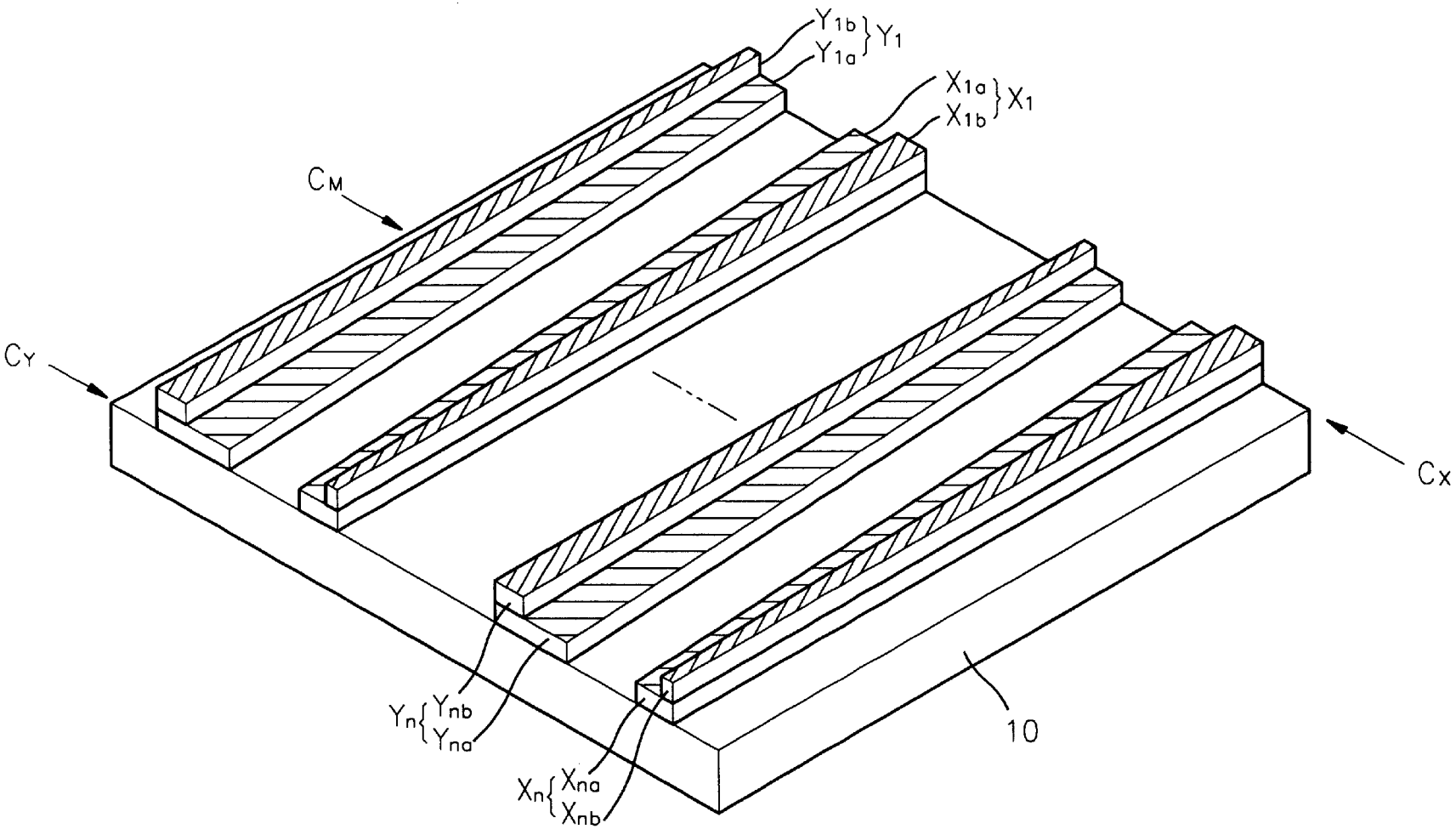
FIG. 6 is a perspective view showing common electrode lines and scan electrode lines of a three-electrode surface-discharge ACPDP according to a second embodiment of the present invention.

FIG. 6 shows common electrode lines $X_1$, $X_2$, $X_n$ and scan electrode lines $Y_1$, $Y_2$, $Y_n$ of a three-electrode face discharge ACPDP according to a second embodiment of the present invention. In FIG. 6, the same functional elements as those of FIG. 5 are denoted by the same reference numerals. Comparing the electrode line structure of FIG. 6 with that of FIG. 5, the common ITO electrode lines $X_{1a}$, $X_{2a}$, $X_{na}$ and the scan ITO electrode lines $X_{1b}$, $X_{2b}$, $X_{nb}$ . . . ; as well as the common bus electrode lines $X_{1b}$, $X_{2b}$, $X_{nb}$ and the scan bus electrode lines $Y_{1b}$, $Y_{2b}$, $Y_{nb}$, have trapezoidal top surfaces. The operation and effect attributable to such configuration is the same as described in FIG. 5, and it is predictable that the effect according to the structure shown in FIG. 6 is further increased compared to that in FIG. 5.

Figure 7:
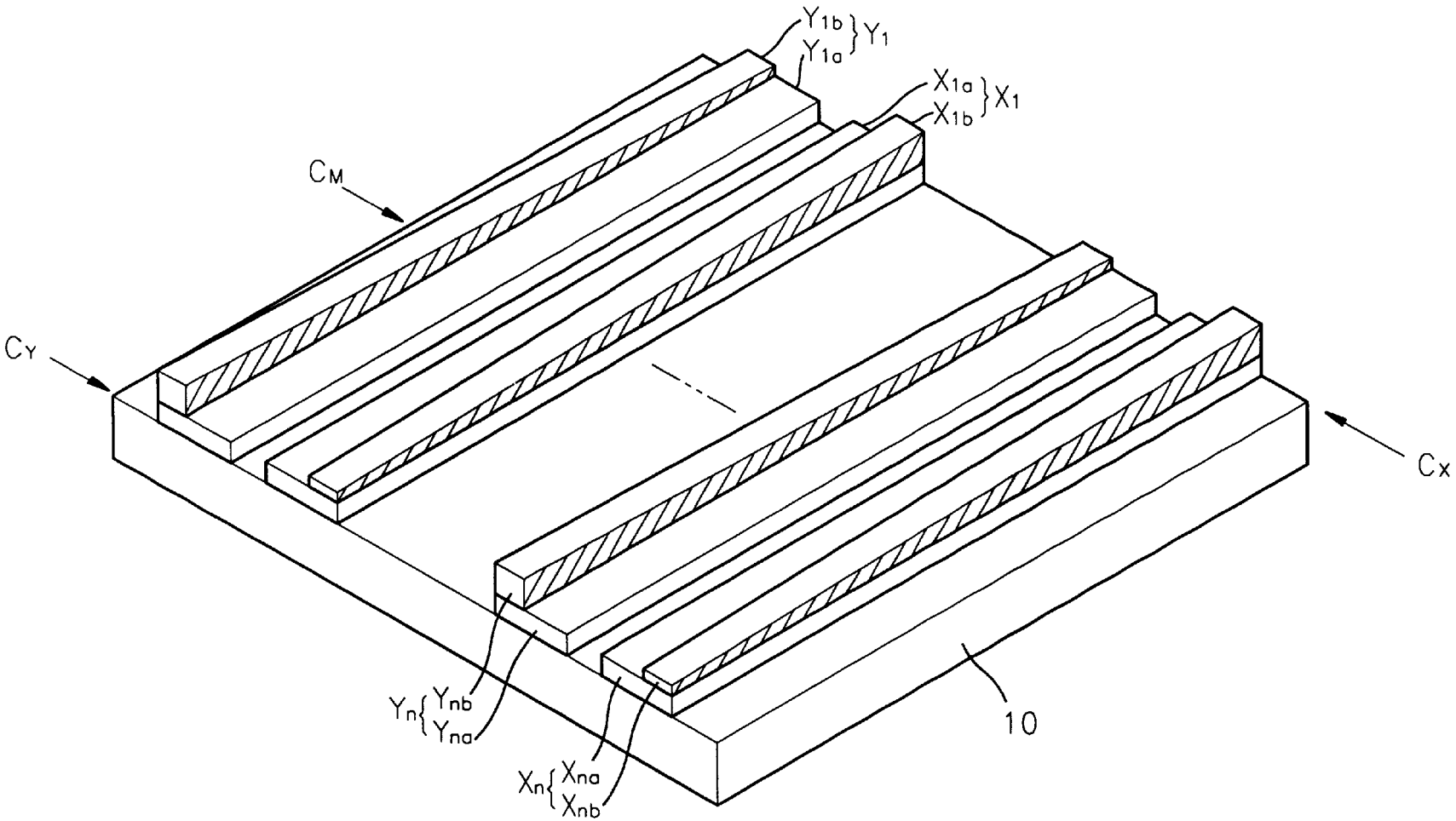
FIG. 7 is a perspective view showing common electrode lines and scan electrode lines of a three-electrode surface-discharge ACPDP according to a third embodiment of the present invention.

FIG. 7 shows common electrode lines $X_1$, $X_2$, $X_n$ and scan electrode lines $Y_1$, $Y_2$, $Y_n$ of a three-electrode face discharge ACPDP according to a third embodiment of the present invention. In FIG. 7, reference numeral 10 denotes a front-surface glass substrate. Referring to FIG. 7, the electrode line structure is configured such that the positions $C_X$ of input terminals to which driving signals corresponding to the common electrode lines $X_1$, $X_2$, $X_n$ are input are opposite to the positions $C_Y$ of input terminals to which driving signals corresponding to the scan electrode lines $Y_1$, $Y_2$, $Y_n$ are input. The respective common bus electrode lines $X_{1b}$, $X_{2b}$, $X_{nb}$ and the respective scan bus electrode lines $Y_{1b}$, $Y_{2b}$, $Y_{nb}$ have lengthwise trapezoidal cross-sections. The lengthwise cross-sections of the respective common bus electrode lines $X_{1b}$, $X_{2b}$, $X_{nb}$ and the respective scan bus electrode lines $Y_{1b}$, $Y_{2b}$, $Y_{nb}$ are trapezoidal. The cross-sectional areas of the respective common bus electrode lines $X_{1b}$, $X_{2b}$, $X_{nb}$ and the respective scan bus electrode lines $Y_{1b}$, $Y_{2b}$, $Y_{nb}$ increase toward the corresponding input terminals $C_X$ and $C_Y$. In other words, the cross-sectional resistances of the common bus electrode lines $X_{1b}$, $X_{2b}$, $X_{nb}$ and the scan bus electrode lines $Y_{1b}$, $Y_{2b}$, $Y_{nb}$ decrease toward the corresponding input terminal positions $C_X$ and $C_Y$. The operation and effect attributable to such configuration are the same as described with respect to FIG. 5. In addition, the lengthwise cross sections of the common ITO electrode lines $X_{1a}$, $X_{2a}$, $X_{na}$ and the scan ITO electrode lines $Y_{1a}$, $Y_{2a}$, $Y_{na}$ are trapezoidal, thereby further enhancing the effect.

Figure 8:
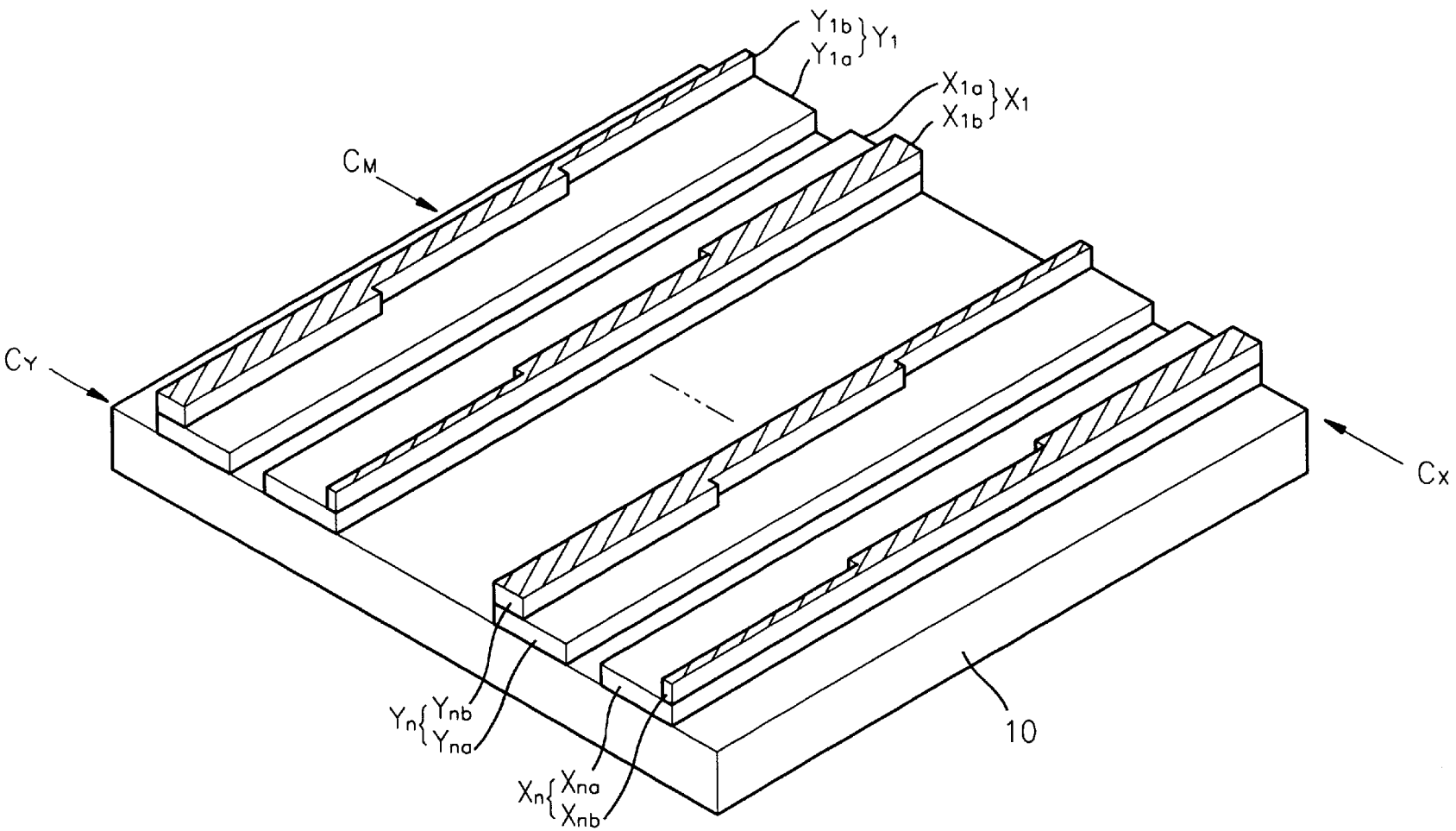
FIG. 8 is a perspective view showing common electrode lines and scan electrode lines of a three-electrode surface-discharge ACPDP according to a fourth embodiment of the present invention.

FIG. 8 shows common electrode lines $X_1$, $X_2$, $X_n$ and scan electrode lines $Y_1$, $Y_2$, $Y_n$ of a three-electrode face discharge ACPDP according to a fourth embodiment of the present invention. In FIG. 8, reference numeral 10 denotes a front-surface glass substrate. Referring to FIG. 8, the electrode line structure is configured such that the positions $C_X$ of input terminals to which driving signals corresponding to the common electrode lines $X_1$, $X_2$, $X_n$ are opposite to the positions $C_Y$ of input terminals to which driving signals corresponding to the scan electrode lines $Y_1$, $Y_2$, $Y_n$. The top surface areas of the respective common bus electrode lines $X_{1b}$, $X_{2b}$, $X_{nb}$ and the respective scan bus electrode lines $Y_{1b}$, $Y_{2b}$, $Y_{nb}$ increase in three steps toward the corresponding input terminals $C_X$ and $C_Y$. In other words, the cross-sectional resistances of the common bus electrode lines $X_{1b}$, $X_{2b}$, $X_{nb}$ and the scan bus electrode lines $Y_{1b}$, $Y_{2b}$, $Y_{nb}$ gradually decrease toward the corresponding input terminal positions $C_X$ and $C_Y$. In addition, although not shown, the top surface areas of the common ITO electrode lines $X_{1a}$, $X_{2a}$, $X_{na}$ and the scan ITO electrode lines $Y_{1a}$, $X_{2a}$, $Y_{na}$ gradually increase toward the corresponding input terminal positions $C_X$ and $C_Y$, thereby further enhancing the effect.

Figure 9:
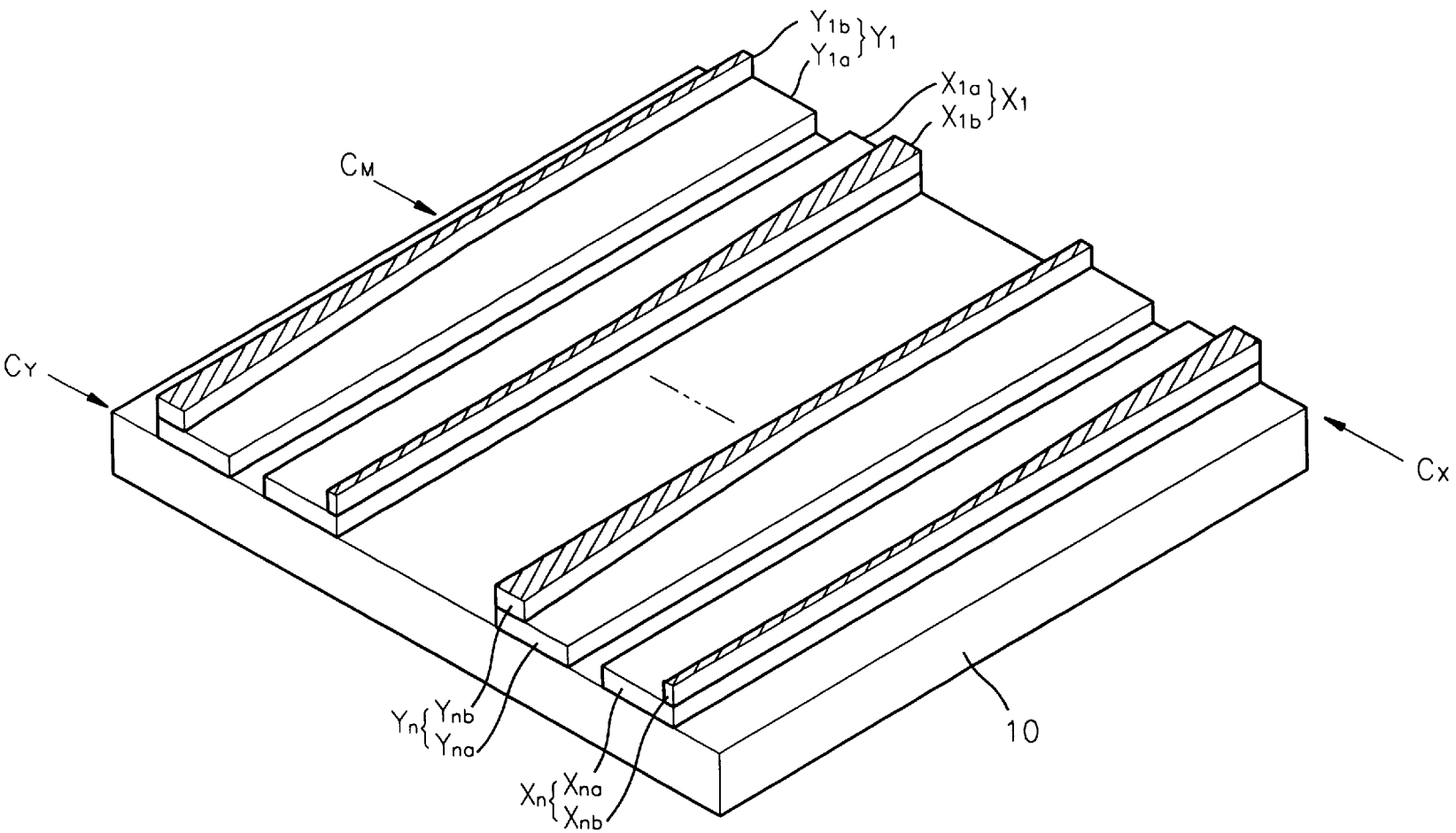
FIG. 9 is a perspective view showing common electrode lines and scan electrode lines of a three-electrode surface-discharge ACPDP according to a fifth embodiment of the present invention.

FIG. 9 shows common electrode lines $X_1$, $X_2$, $X_n$ and scan electrode lines $Y_1$, $Y_2$, $Y_n$ of a three-electrode face discharge ACPDP according to a fifth embodiment of the present invention. In FIG. 9, reference numeral 10 denotes a front-surface glass substrate. Referring to FIG. 9, the electrode line structure is configured such that the positions $C_X$ of input terminals to which driving signals corresponding to the common electrode lines $X_1$, $X_2$, $X_n$ are applied are opposite to the positions $C_Y$ of input terminals to which driving signals corresponding to the scan electrode lines $Y_1$, $Y_2$, $Y_n$ are applied. The top surface areas of the respective common bus electrode lines $X_{1b}$, $X_{2b}$, $X_{nb}$ and the respective scan bus electrode lines $Y_{1b}$, $Y_{2b}$, $Y_{nb}$ gradually increase toward the corresponding input terminals $C_X$ and $C_Y$. In other words, the cross-sectional resistances of the common bus electrode lines $X_{1b}$, $X_{2b}$, $X_{nb}$ and the scan bus electrode lines $Y_{1b}$, $Y_{2b}$, $Y_{nb}$ gradually decrease lengthwise from the central positions $C_M$ toward the corresponding input terminal positions $C_X$ and $C_Y$. The operation and effect attributable to such configuration are the same as described with respect FIG. 5. In addition, although not shown, the top surface areas of the common ITO electrode lines $X_{1a}$, $X_{2a}$, $X_{na}$ and the scan ITO electrode lines $Y_{1a}$, $Y_{2a}$, $Y_{na}$ gradually increase from the central positions $C_M$ toward the corresponding input terminal positions $C_X$ and $C_Y$, thereby further enhancing the effect.

As described above, in the ACPDP according to the present invention, the cross-sectional resistances values of the respective common bus electrode lines and the respective scan bus electrode lines gradually decrease toward the corresponding input terminal positions. In other words, when a voltage is applied to the corresponding input terminals, the amount of current flowing between the input terminals and the central positions can be maximized. Accordingly, since the amounts of discharge current and the luminance at the central positions of the common bus electrode lines and the scan bus electrode lines are relatively increased, the picture quality can be improved by the uniform luminance of the display throughout the screen.

Although the invention has been described with respect to preferred embodiments, it is not to be so limited as changes and modifications can be made

What is claimed is:

1. An alternating-current plasma display panel comprising:

first and second substrates disposed opposite and spaced apart from each other;

common electrode lines and scan electrode lines, parallel to each other, supported by the first substrate, and arranged between the first and second substrates; and address electrode lines supported by the second substrate and arranged between the first and second substrates, and orthogonal to the common electrode lines and the scan electrode lines, defining respective pixels where the address electrode lines cross the common and scan electrode lines, wherein the common electrode lines and the scan electrode lines extend between opposite first and second edges of the first substrate, and surface areas of the common electrode lines increase from the first edge to the second edge of the first substrate and surface areas of the scan electrode lines increase from the second edge to the first edge of the first substrate.

2. The alternating-current plasma display panel according to claim 1, wherein the surface areas of the common electrode lines and the scan electrode lines facing the second substrate are trapezoidal.

3. The alternating-current plasma display panel according to claim 1, wherein lengthwise cross sections of the common electrode lines and the scan electrode lines transverse to the first substrate are trapezoidal.

4. The alternating-current plasma display panel according to claim 1, wherein the surface areas of the common electrode lines and the scan electrode lines facing the second substrate gradually increase toward the second and first edges of the first substrate, respectively.

5. The alternating-current plasma display panel according to claim 1, wherein cross-sectional areas of the common electrode lines and the scan electrode lines gradually increase from respective central positions of the common electrode lines and the scan electrode lines toward the second and first edges of the first substrate, respectively.

6. The alternating-current plasma display panel according to claim 1, wherein the common electrode lines and the scan electrode lines each include respective metal bus electrode lines and corresponding transparent electrode lines, and areas of the metal bus electrode lines of the common electrode lines increase from the first edge to the second edge of the first substrate and the areas of the metal bus electrode lines of the scan electrode lines increase from the second edge to the first edge of the substrate.

7. The alternating-current plasma display panel according to claim 1, wherein the surface areas of the common electrode lines and the scan electrode lines increase stepwise toward the second and first edges of the first substrate, respectively.

8. The alternating-current plasma display panel according to claim 6, wherein the surface areas of the metal bus electrode lines of the common and scan electrode lines facing the second substrate are trapezoidal.

9. The alternating-current plasma display panel according to claim 6, wherein lengthwise cross sections of the metal bus electrode lines of the common and scan electrode lines transverse to the first substrate are trapezoidal.

10. The alternating-current plasma display panel according to claim 6, wherein the surface areas of the metal bus electrode lines of the common and scan electrode lines facing the second substrate gradually increase toward the second and first edges of the first substrate, respectively.

11. The alternating-current plasma display panel according to claim 6, wherein the surface areas of the metal bus electrode lines of the common and scan electrode lines increase stepwise toward the second and first edges of the first substrate, respectively.

* * * * *